US006199040B1

(12) United States Patent
Fette et al.

(10) Patent No.: US 6,199,040 B1
(45) Date of Patent: Mar. 6, 2001

(54) SYSTEM AND METHOD FOR COMMUNICATING A PERCEPTUALLY ENCODED SPEECH SPECTRUM SIGNAL

(75) Inventors: Bruce Alan Fette, Mesa; Cynthia Ann Jaskie, Scottsdale, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/122,610

(22) Filed: Jul. 27, 1998

(51) Int. Cl.[7] ..... G10L 19/00
(52) U.S. Cl. ..... 704/230; 704/219; 704/222
(58) Field of Search ..... 704/230, 220, 704/221, 222, 223, 229, 219

(56) References Cited

U.S. PATENT DOCUMENTS

| | | | | |
|---|---|---|---|---|
| 4,896,361 | * | 1/1990 | Gerson | 704/229 |
| 5,396,576 | * | 3/1995 | Miki et al. | 704/222 |
| 5,848,387 | * | 12/1998 | Nishigushi et al. | 704/214 |
| 5,987,406 | * | 11/1999 | Honkanen et al. | 704/220 |
| 6,018,707 | * | 1/2000 | Nishigushi et al. | 704/222 |
| 6,073,092 | * | 6/2000 | Kwon | 704/219 |

OTHER PUBLICATIONS

An article entitled "Efficient Search and Design Procedures for Robust Multi–Stage VQ of LPC Parameters for 4 kb/s Speech Coding" by W.P. LeBlanc, B. Bhattacharya, S.A. Mahmoud and V. Cuperman, from the IEEE Transactions On Speech And Audio Processing, vol. 1, No. 4, Oct. 1993.

An article entitled "Spectral Coding By Fast Vector Quantization" by Erik Agrell, Department of Information Theory, Chalmers University of Technology, S–412 96 Goteborg, Sweden.

An article entitled "Vector/Matrix Quantization For Narrow–Bandwidth Digital Speech Compression" by David Y. Wong, from Signal Technology, Inc. Goleta, CA.

An article entitled "High–Quality 800–B/S Voice Processing Algorithm", by G.S. Kang and L.J. Fransen from Naval Research Lab., Washington, D.C.

An article entitled "Single Stage Spectral Quantization at 20 bits" by Per Hedelin from the Department of Information Theory, Chalmers University of Technology, S–41296 Goteborg, Sweden.

* cited by examiner

*Primary Examiner*—David Hudspeth
*Assistant Examiner*—Susan Wieland
(74) *Attorney, Agent, or Firm*—Sherry J. Whitney; Gregory J. Gorrie; Maurice J. Jones

(57) ABSTRACT

System efficiently communicates a perceptually encoded speech spectrum signal from a transmitter to a receiver. The transmitter includes a speech analyzer which accepts a speech signal input and generates a parameterized speech signal. The transmitter also includes a vector quantizer for generating the perceptually encoded speech spectrum signal from the parameterized speech signal. The receiver decodes the perceptually encoded speech spectrum signal to produce decoded spectral parameters to further produce a synthetic speech output. The vector quantizer performs a method for partitioning a vector quantizer (VQ) codebook to produce perceptually organized sub-codebooks. The vector quantizer performs a second method for quantizing a vector based on the perceptually organized sub-codebooks. The second method identifies a vector, from one of the perceptually organized sub-codebooks, to perceptually model the speech signal input.

8 Claims, 3 Drawing Sheets

100

SYSTEM AND METHOD FOR COMMUNICATING A PERCEPTUALLY ENCODED SPEECH SPECTRUM SIGNAL

FIELD OF THE INVENTION

This invention relates in general to a system for communicating encoded speech, and more specifically, to a system for communicating perceptually encoded speech.

BACKGROUND OF THE INVENTION

Systems for communicating encoded speech at low bit rates commonly include quantizing a vector which represents the shape of the vocal tract for a speaker. Vectors consisting of ten Line Spectral Frequencies (LSFs) are commonly used to represent the vocal tract for each speech frame for the speaker. Commonly, each speech frame is from 10 to 40 ms of sampled speech. A problem with systems using techniques which substitute a codebook vector for a vector representing a speech sample is the excessive time required to search a vector quantizer (VQ) codebook. Typically, a vector including ten LSFs can be adequately characterized by a twenty-four bit VQ without sacrificing perceptual quality. However, another problem is determining which vector from the set of vectors in the VQ codebook represents the best perceptual model for a speech sample. For example, when a twenty-four bit VQ codebook is "searched", the search includes comparing a ten dimensional input vector which represents the speech sample with $2^{24}$ VQ codebook vectors.

Techniques such as Multi-stage and split VQ can reduce the time to search a VQ codebook. However, a problem with such techniques is that, while typically reducing the time to search a VQ codebook, the vector selected to represent the speech sample fails to be perceptually optimal. So, another problem with existing techniques is that they do not efficiently determine a vector from a VQ codebook which represents the best perceptual model for a speech sample.

Thus, what is needed is a system and method for communicating a perceptually encoded speech spectrum signal in a time efficient manner. What is also needed is a system and method which search a VQ codebook for a vector which perceptually models a speech signal. Also needed is a system and method which improve the speed for searching a VQ codebook. What is also needed is a system and method which efficiently determine a vector to perceptually model a speech signal.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

The exemplification set out herein illustrates a preferred embodiment of the invention in one form thereof, and such exemplification is not intended to be construed as limiting in any manner.

DETAILED DESCRIPTION OF THE PREFERRED EMBODIMENT

The present invention provides a system and methods for efficiently communicating a perceptually encoded speech spectrum signal from a transmitter to a receiver. The transmitter includes a speech analyzer which accepts a speech signal input and generates a parameterized speech signal. The transmitter also includes a vector quantizer for generating the perceptually encoded speech spectrum signal from the parameterized speech signal. A "perceptually encoded speech spectrum signal" is generally defined to mean an encoded speech spectrum signal which has been quantized from a codebook having vectors grouped perceptually. The receiver decodes the perceptually encoded speech spectrum signal to produce decoded spectral parameters that further produce a synthetic speech output. The vector quantizer performs a method for partitioning a vector quantizer (VQ) codebook to produce perceptually organized sub-codebooks. The vector quantizer performs a second method for quantizing a vector (e.g., the parameterized speech signal) based on the perceptually organized sub-codebooks. The second method identifies a vector, from one of the perceptually organized subcodebooks, to perceptually model the speech signal.

The present invention also provides a system and method for communicating a perceptually encoded speech spectrum signal in a time efficient manner. The present invention also provides a system and method which search a VQ codebook for a vector which perceptually models a speech signal. The present invention also provides a system and method which improve the speed for searching a VQ codebook. The present invention also provides a system and method which efficiently determine a vector to perceptually model a speech spectrum signal.

Figure 1:
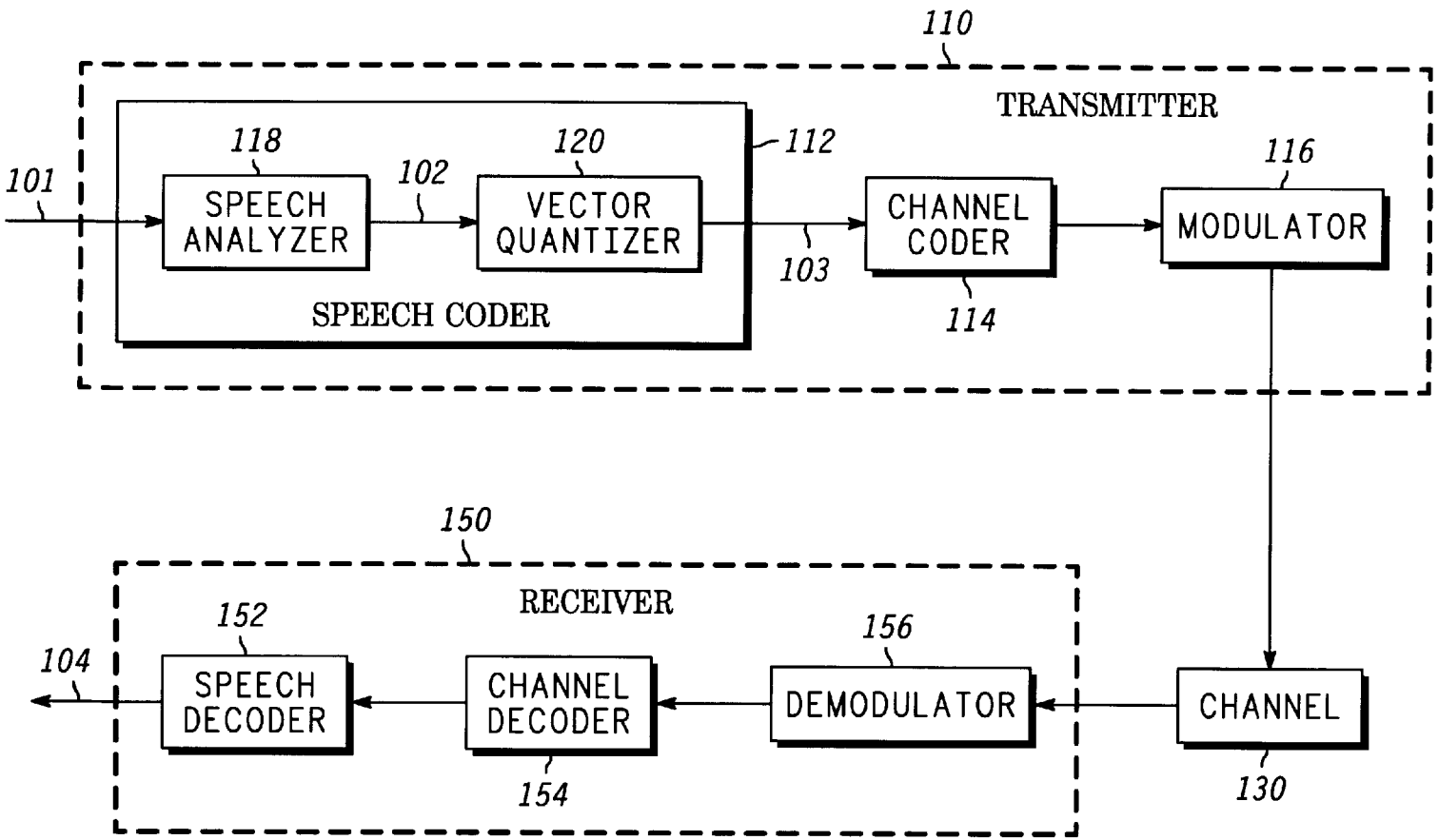
FIG. 1 is a simplified block diagram of a system for communicating a perceptually encoded speech spectrum signal in accordance with a preferred embodiment of the present invention.

FIG. 1 is a simplified block diagram for a system for communicating a perceptually encoded speech spectrum signal in accordance with a preferred embodiment of the present invention. System 100, in FIG. 1, primarily shows a system for communicating a speech spectrum signal. In a preferred embodiment, the speech spectrum signal is encoded, in part, using a novel method for vector quantization. Speech coding at higher bit rates (e.g., above or equal to 4.8 kilobits per second (kb/s)) can be accomplished by directly modeling a speech signal such as speech signal input 101. Speech coding at lower bit rates (e.g., below 4.8 kb/s) are preferably modeled by frames of speech which are decomposed into perceptually meaningful parameters. These parameters are preferably quantized for communication through a channel or for compact storage of speech information. The number of bits available for quantizing a parameter is generally limited by channel capacity or storage constraints, wherein fewer bits produce a lower quality result. Typically, synthetic speech such as synthetic speech output 104 is reconstructed from these quantized parameters. A typical parameter set for each frame includes: a vector to represent the shape of a vocal tract (e.g., LSFs or spectrum), frame pitch, frame energy and possibly some characterization of an excitation waveform.

An N dimensional (e.g., N=10, 12, 14) Linear Predictive Analysis is generally used to produce a vector of N coefficients to represent the spectrum or shape of the vocal tract.

The N dimensional vector may be transformed into one of many domains, such as prediction coefficients, reflection coefficients, autocorrelation coefficients, cepstral coefficients, and line spectral frequencies (LSFs) to determine a domain to quantize the parameters efficiently. A ten dimensional vector of LSFs is most commonly used to show that twenty-four bits can adequately quantize a ten dimensional LSF vector when a vector quantizer (VQ) is used. These ten LSFs are preferably transformed to a range from 0–4000 Hertz (Hz). LSFs have a property where closely spaced LSFs indicate the presence of a formant frequency, or resonant frequency for the vocal tract. The first, or lowest frequency, formant is often the "highest energy and peakiest" so the difference between the first LSF (e.g., LSF1) and the second LSF (e.g., LSF2) or between LSF2 and the third LSF (e.g., LSF3) is the smallest. The fine quantization for formant frequencies, and hence the closely spaced LSFs is especially important for good perceptual quality.

A VQ is a list, or codebook of vectors which has been trained to represent a set of vectors to be quantized. Quantization involves comparing an input vector, for example, an input speech spectrum signal, to each of the vectors in the codebook to find the one vector in the codebook which best matches perceptual criteria for the input vector. An index for the vector determined from the codebook is preferably communicated in lieu of the vector.

Methods for vector quantization which reduce the storage size and search time for a twenty-four bit VQ can be practically implemented. Two methods which reduce storage size and search time for vector quantization are a multi-stage VQ and a split VQ. An N-dimensional twenty-four bit multi-stage VQ may first employ an N-dimensional twelve bit VQ and determine the quantizing error between an input vector and the determined vector from the codebook. The "error vector" could then be quantized with an N-dimensional, twelve bit VQ for error vectors. The storage size and search time for the twelve bit VQs is substantially less than for a "full" twenty-four bit VQ. The storage size and search time would be further reduced for an eight, eight, and eight bit or a ten, eight, and six bit multi-stage VQ.

A split VQ for quantizing ten LSFs preferably employs a four dimensional, twelve bit VQ for quantizing a vector for the first four LSFs and a six dimensional, twelve bit VQ for quantizing a vector for the last six LSFs. Multi-stage and split VQs reduce storage size and search time, but have a lower perceptual quality than a full search VQ. Perceptual quality for a multi-stage VQ may be increased by retaining a set of the best vectors at each stage to apply to the next stage, however search time is also increased.

In a preferred embodiment of the present invention, VQ search time is reduced without further reducing perceptual quality. The present invention may be applied to, among other things, a full VQ, a multi-stage VQ, and a split VQ. The present invention primarily reduces search time for a VQ by partitioning the codebook in a perceptually meaningful way. An N-dimensional codebook can be searched more quickly when partitioned into a number of smaller N-dimensional sub-codebooks. The present invention partitions a codebook into sub-codebooks by grouping vectors for the codebook which are perceptually most similar. So, when a sub-codebook is determined to be searched, a best perceptual match for the input vector is within the sub-codebook.

In another embodiment of the present invention, VQ search time may be reduced by determining a structure for a codebook so that N-dimensional adjacency relationships between neighboring vectors are determined. In this embodiment, additional memory would be required to store tables in vector quantizer 120 to describe adjacency relationships. This embodiment of the present invention reduces search time by describing a path through a codebook to search such that successive comparisons would determine only a small set of vectors to search which preferably produce less quantization error.

In a preferred embodiment of the present invention, system 100 generally includes transmitter 110 coupled to receiver 150 via channel 130. Preferably, transmitter 110 further includes: speech coder 112, channel coder 114, and modulator 116. Preferably, speech coder 112 further includes: speech analyzer 118 and vector quantizer 120. Channel 130 represents a wireless channel, however channel 130 may represent, among other things, a "wired" channel such as a fiber optic channel or a twisted pair channel.

Receiver 150 preferably includes: demodulator 156, channel decoder 154, and speech decoder 152.

In a preferred embodiment of the present invention, speech analyzer 118 accepts speech signal input 101 and generates parameterized speech signal 102. Vector quantizer 120 accepts parameterized speech signal 102 and generates perceptually encoded speech spectrum signal 103.

Perceptually encoded speech spectrum signal 103 is received by channel coder 114. Preferably, channel coder 114 adds forward error correction (FEC) bits to perceptually encoded speech spectrum signal 103 to provide channel error protection to signal 103. Modulator 116 preferably accepts the protected signal from channel coder 114 and provides a modulated signal to channel 130. Receiver 150 preferably receives the modulated signal from channel 130 via demodulator 156. Demodulator 156 demodulates the modulated signal and forwards the demodulated signal to channel decoder 154. Channel decoder 154 preferably provides error detection and correction to the demodulated signal and subsequently provides an error corrected signal to speech decoder 152.

Speech decoder 152 decodes the error corrected signal to synthesize a speech output, namely synthetic speech output 104.

In the preferred embodiment of the present invention, vector quantizer 120 generally includes a means for receiving a parameterized signal, and a means for generating a perceptually encoded speech spectrum signal.

A method for generating a perceptually encoded speech spectrum signal is discussed below.

Figure 2:
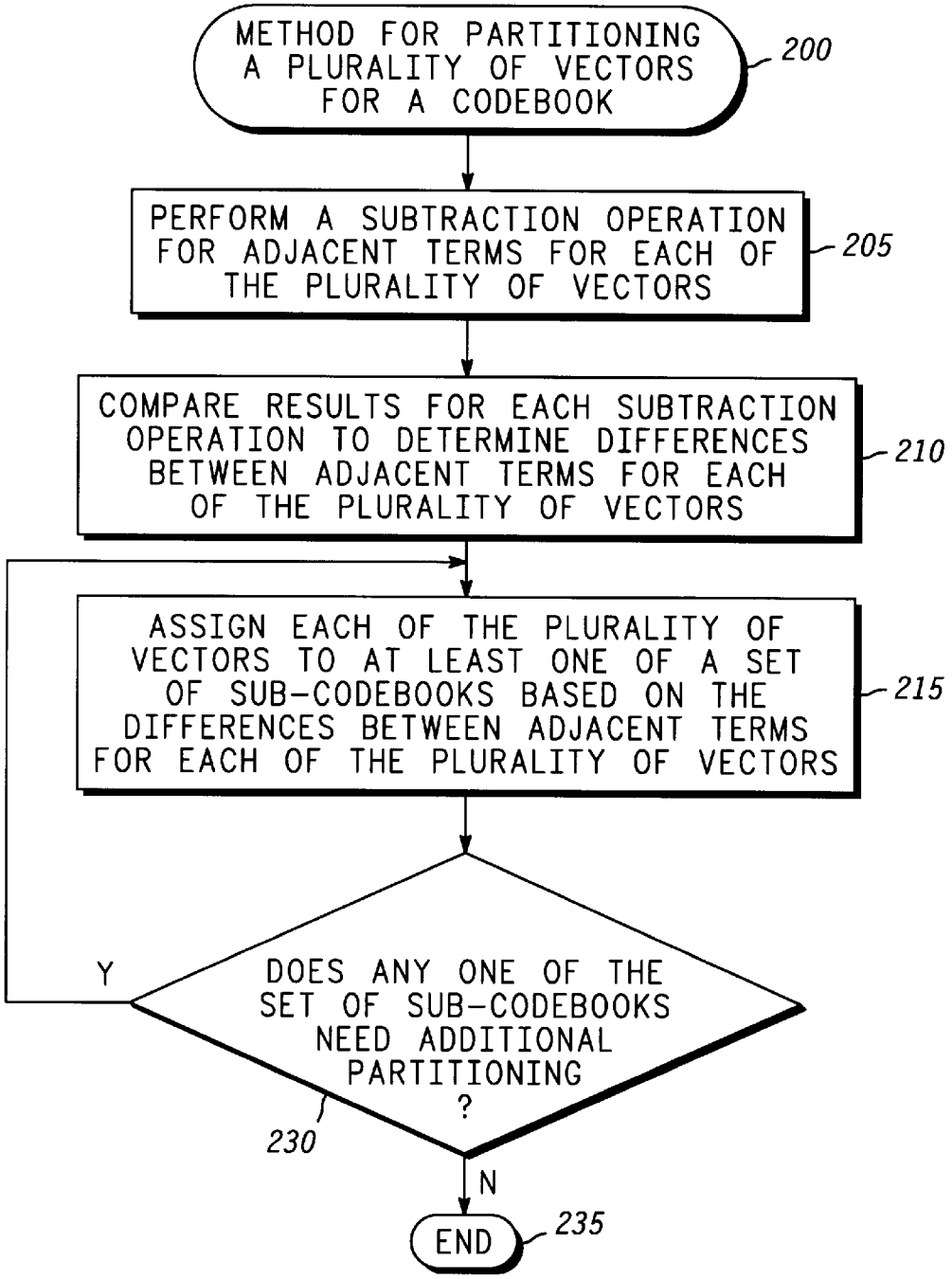
FIG. 2 is a simplified flow chart for a method for partitioning a plurality of vectors for a codebook in accordance with a preferred embodiment of the present invention.

FIG. 2 is a simplified flow chart for a method for partitioning a plurality of vectors for a codebook in accordance with a preferred embodiment of the present invention. In a preferred embodiment, method 200 is a method for partitioning a plurality of vectors for a codebook into a set of sub-codebooks. Preferably, each of the plurality of vectors is assigned to a sub-codebook based on perceptual information determined from the coefficients for the vector associated therewith.

In step 205, subtraction operations for adjacent terms for each of the plurality of vectors is performed. In the preferred embodiment, each vector is represented by a vector having ten coefficients. Preferably, each coefficient represents one line spectral frequency (LSF). For example, assume that the ten coefficients for a vector representing a set of LSFs is as follows: 478, 578, 1040, 1487, 1604, 2043, 2359, 2622, 3316, 3540, wherein the coefficients represent LSFs between 0 and 4000 Hz. Further assume each of the coefficients is identified by a label, for example, LSF1, LSF2, LSF3, LSF4, LSF5, LSF6, LSF7, LSF8, LSF9, and LSF10, respectively. Step 205 includes performing the following subtraction operations: LSF2–LSF1, LSF3–LSF2, LSF4–LSF3, LSF5–LSF4, LSF6–LSF5, LSF7–LSF6, LSF8–LSF7, LSF9–LSF8, and LSF10–LSF9, each subtraction operation representing at least one sub-codebook (e.g., sub-codebook 1 is represented by LSF2–LSF1). In another embodiment, step 205 includes subtraction operations such as: LSF1–0(Hz), LSF2–LSF1, LSF10–LSF9, and 4000(Hz)–LSF10.

In step 210, results from the subtraction operations for each of the plurality of vectors are compared. In the preferred embodiment, the results from step 205 are compared and ordered from smallest difference to largest difference. For the example in step 205, the smallest difference between coefficients is determined by LSF2–LSF1 (e.g., 578–478= 100).

In step 215, each of the plurality of vectors is assigned to at least one of a set of sub-codebooks based on the differences between adjacent terms for each of the plurality of vectors. In the preferred embodiment, the vector shown in the example in steps 205–210 is assigned to sub-codebook 1 because the difference between LSF1 and LSF2 is the smallest.

In step 230, a check is performed to determine when any one of the set of sub-codebooks needs additional partitioning. In the preferred embodiment, when any one of the sub-codebooks is assigned more vectors than a predetermined percentage of vectors, for example, more than 25 percent of the entire codebook, the sub-codebook is further partitioned. In a preferred embodiment, an example step for further partitioning the sub-codebook is based on the LSF pair having the second smallest difference. Sub-dividing the sub-codebooks is preferably performed until no sub-codebook contains more than the predetermined percentage of vectors. In other embodiments, other partitioning schemes are possible such as a tree process. Method 200 then ends 235.

Figure 3:
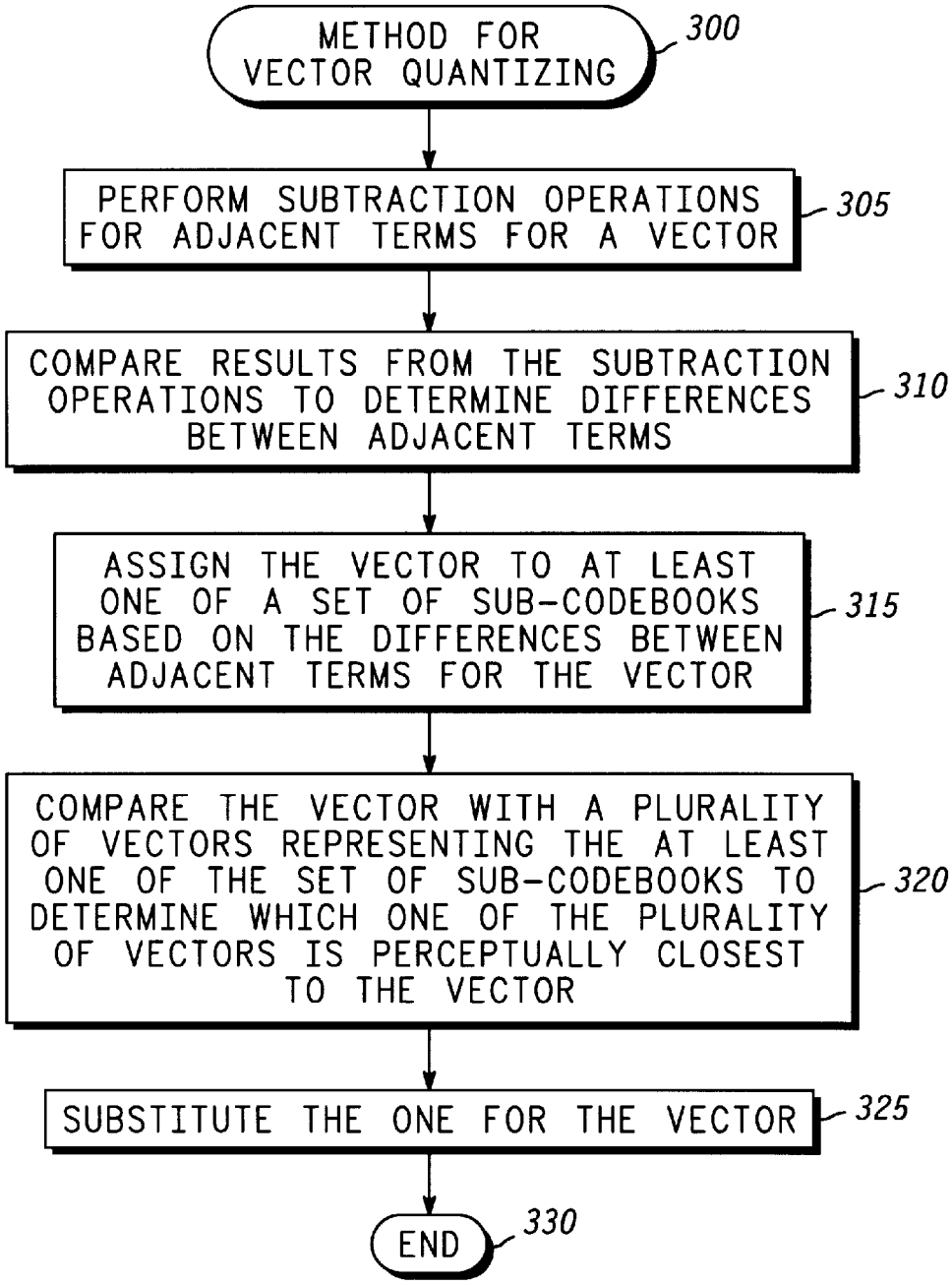
FIG. 3 is a simplified flow chart for a method for vector quantizing in accordance with a preferred embodiment of the present invention.

FIG. 3 is a simplified flow chart for a method for vector quantizing in accordance with a preferred embodiment of the present invention. In a preferred embodiment, method 300 is a method for quantizing an input vector. Preferably, the input vector is identified as "belonging to" at least one of a predetermined set of sub-codebooks. Then, a search is performed within the "identified" sub-codebook to determine a vector which is to be substituted for the input vector.

In step 305, subtraction operations for adjacent terms for the vector are performed. In a preferred embodiment, step 305 is performed similar to step 205 (FIG. 2). The vector is preferably represented by ten coefficients. Preferably, each coefficient represents one LSF. For example, assume that the ten coefficients for the vector represent the following LSFs: 479, 578, 1040, 1487, 1604, 2043, 2359, 2622, 3316, and 3540. Further assume each of the coefficients is identified by a label, for example, LSF1, LSF2, LSF3, LSF4, LSF5, LSF6, LSF7, LSF8, LSF9, and LSF10, respectively. Step 305 includes performing the following subtraction operations: LSF2–LSF1, LSF3–LSF2, LSF4–LSF3, LSF5–LSF4, LSF6–LSF5, LSF7–LSF6, LSF8–LSF7, LSF9–LSF8, and LSF10–LSF9 for the vector.

In step 310, results for each subtraction operation are compared. In the preferred embodiment, the results from step 305 are compared and ordered from smallest difference to largest difference. For the example in step 305, the smallest difference between coefficients is determined by LSF2–LSF1. So, step 310 determines which sub-codebook to search to quantize an LSF vector.

In step 315, the vector is assigned to at least one of a set of sub-codebooks based on step 310. In the preferred embodiment, the vector shown in the example in steps 305–310 is assigned to a sub-codebook where "LSF2–LSF1" is the smallest difference between LSFs.

In step 320, the vector is compared with a plurality of vectors representing the at least one sub-codebook. In the preferred embodiment, the vector is compared to each one of the plurality of vectors in the sub-codebook to determine which one is perceptually closest to the vector. In a preferred embodiment, the comparison between vectors is determined by performing a perceptual distance measure, for example, a Euclidean distance, Itakura's likelihood ratio, or a weighted Euclidean distance where the distance between lower order LSFs is given more weight than an error between higher order LSFs.

In step 325, the one vector from the sub-codebook is substituted for the vector. In the preferred embodiment, the vector from the sub-codebook having the smallest perceptual distance (i.e., closest match) from the vector is substituted for the vector. Preferably, when a vector is substituted for another vector, an index into the sub-codebook identifies the vector from the sub-codebook. The index is preferably communicated in a system in lieu of communicating the vector from the sub-codebook. Method 300 then ends 330.

In a preferred embodiment of the present invention, methods 200 and 300 are applied to a full search VQ, a multi-stage VQ, and a split VQ. Applying methods 200 and 300 to each of these VQs improves the perceptual quality for the vector substituted by the quantizer and reduces the search time for the VQ.

Thus, what has been shown are a system and method for communicating a perceptually encoded speech spectrum signal in a time efficient manner. What has also been shown are a system and method which search a VQ codebook for a vector which perceptually models a speech spectrum signal. What has also been shown are a system and method which improve the speed for searching VQ codebook. Also shown are a system and method which efficiently determine a vector to perceptually model a speech signal.

What is claimed is:

1. A system for communicating an encoded speech signal comprising:

a transmitter for generating a perceptually encoded speech spectrum signal; and a receiver for decoding the perceptually encoded speech spectrum signal;

wherein the transmitter further includes:

a speech analyzer for generating a parameterized speech signal comprised of a plurality of vectors for a codebook; and a vector quantizer for generating the perceptually encoded speech spectrum signal from the parameterized speech signal, wherein said vector quantizer performs a subtraction operation for first adjacent terms for each of the plurality of vectors for the codebook, compares results for the subtraction operation for the first adjacent terms to determine differences between the first adjacent terms for each of the plurality of vectors, assigns each of the plurality of vectors to at least one of a set of sub-codebooks based on the differences between the first adjacent terms for each of the plurality of vectors, assigns a vector to a sub-codebook based on differences between second adjacent terms for the vector, compares the vector with each of a second plurality of vectors representing the sub-codebook to determine which one of the second plurality of vectors is perceptually closest to the vector, and substitutes the one for the vector.

2. A system as claimed in claim 1, wherein the vector quantizer includes:

means for receiving the parameterized speech signal; and means for generating the perceptually encoded speech spectrum signal from the parameterized speech signal.

3. A system as claimed in claim 2, wherein the means for generating the perceptually encoded speech spectrum signal is part of a full vector quantizer.

4. A system as in claim 2, wherein the means for generating the perceptually encoded speech spectrum signal is part of at least one stage of a multi-stage vector quantizer.

5. A system as claimed in claim 2, wherein the means for generating the perceptually encoded speech spectrum signal is part of a first stage of a split vector quantizer.

6. A system as claimed in claim 2, wherein the means for generating the perceptually encoded speech spectrum signal is part of a second stage of a split vector quantizer.

7. A method for communicating an encoded speech signal, the method comprising the steps of:

performing a subtraction operation for first adjacent terms for each of a plurality of vectors for a codebook;

comparing results for the subtraction operation for the first adjacent terms to determine differences between the first adjacent terms for each of the plurality of vectors;

assigning each of the plurality of vectors to at least one of a set of sub-codebooks based on the differences between the first adjacent terms for each of the plurality of vectors, assigning a vector to a sub-codebook based on differences between second adjacent terms for the vector;

comparing the vector with each of a second plurality of vectors representing the sub-codebook to determine which one of the second plurality of vectors is perceptually closest to the vector; and substituting the one for the vector.

8. A method as claimed in claim 7, further comprising the steps of:

performing another subtraction operation for the second adjacent terms for the vector; and comparing results from the subtraction operation to determine differences between the second adjacent terms for the vector.

* * * * *